US007703230B2

(12) United States Patent
Curry et al.

(10) Patent No.: US 7,703,230 B2
(45) Date of Patent: Apr. 27, 2010

(54) POSITIVE STRIKER LOCK SAFETY FOR USE WITH A FIREARM

(75) Inventors: Brett Curry, Chicopee, MA (US); Gary E. Zukowski, Indian Orchard, MA (US)

(73) Assignee: Smith & Wesson Corp., Springfield, MA (US)

( * ) Notice: Subject to any disclaimer, the term of this patent is extended or adjusted under 35 U.S.C. 154(b) by 635 days.

(21) Appl. No.: 11/316,527

(22) Filed: Dec. 22, 2005

(65) Prior Publication Data

US 2006/0162220 A1 Jul. 27, 2006

Related U.S. Application Data

(60) Provisional application No. 60/638,746, filed on Dec. 22, 2004, provisional application No. 60/639,187, filed on Dec. 22, 2004, provisional application No. 60/638,594, filed on Dec. 22, 2004, provisional application No. 60/638,753, filed on Dec. 22, 2004, provisional application No. 60/638,593, filed on Dec. 22, 2004, provisional application No. 60/638,592, filed on Dec. 22, 2004, provisional application No. 60/638,751, filed on Dec. 22, 2004, provisional application No. 60/638,752, filed on Dec. 22, 2004.

(51) Int. Cl.
*F41A 17/72* (2006.01)

(52) U.S. Cl. ..... 42/70.08; 42/70.01

(58) Field of Classification Search ..... 42/70.08, 42/70.01

See application file for complete search history.

(56) References Cited

U.S. PATENT DOCUMENTS 2,169,084 A * 8/1939 Swartz ..... 89/148
3,724,113 A * 4/1973 Ludwig ..... 42/70.08
3,830,002 A * 8/1974 Volkmar ..... 42/70.08
4,011,678 A 3/1977 Brodbeck et al.
4,021,955 A * 5/1977 Curtis ..... 42/70.08
4,031,648 A 6/1977 Thomas
4,522,105 A 6/1985 Atchisson
4,539,889 A 9/1985 Glock
4,555,861 A * 12/1985 Khoury ..... 42/69.01
4,825,744 A 5/1989 Glock
4,843,748 A * 7/1989 Tuma ..... 42/70.08
4,893,546 A 1/1990 Glock
4,967,724 A 11/1990 Senfter
5,012,604 A 5/1991 Rogers
5,018,292 A 5/1991 West
5,024,139 A 6/1991 Knight, Jr. et al.
5,036,612 A 8/1991 Jennings
5,050,480 A 9/1991 Knight, Jr. et al.
5,050,481 A 9/1991 Knight, Jr. et al.
5,081,780 A 1/1992 Lishness et al.

(Continued)

*Primary Examiner*—Troy Chambers
(74) *Attorney, Agent, or Firm*—McCormick, Paulding & Huber LLP

(57) ABSTRACT

A firearm has a frame, a slide, a striker-type firing pin ("striker"), and a fire control mechanism including a sear to controllably release the striker and a trigger bar for actuating the sear. An automatic positive striker lock safety includes a pin-like safety element biased downwards to normally block the striker. The bottom of the pin is rounded, and cooperates with a rearwards facing, sloped surface on the trigger bar. If striker becomes free to move forward without full rearwards movement of the trigger bar, the pin blocks the striker. However, rearward movement of the trigger bar forces the pin upwards. As the trigger bar reaches its fully rearward position, the pin is moved to unblock the striker, and the sear is actuated for releasing the striker.

18 Claims, 4 Drawing Sheets

U.S. PATENT DOCUMENTS 5,086,578 A 2/1992 Lishness et al.
5,086,579 A 2/1992 Flatley et al.
5,088,222 A 2/1992 Larson
5,090,147 A 2/1992 Pastor
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A * 10/1992 Dunn ..... 42/70.08
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Tuma
5,225,612 A 7/1993 Bernkrant
5,235,770 A 8/1993 Simon et al.
5,241,769 A 9/1993 Von Muller
5,247,757 A 9/1993 Deeb
5,251,394 A 10/1993 Bornancini
5,259,138 A * 11/1993 Scirica ..... 42/70.08
5,267,407 A 12/1993 Bornancini
5,272,957 A 12/1993 Chesnut et al.
5,299,374 A 4/1994 Mathys
5,303,494 A 4/1994 Tuma et al.
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A 2/1995 Vaid et al.
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A 8/1995 Lenkarski et al.
5,448,939 A 9/1995 Findlay, Sr. et al.
5,487,233 A 1/1996 Jewell
5,493,806 A 2/1996 Langevin et al.
5,502,914 A 4/1996 Moon
5,517,896 A 5/1996 Perrine
5,517,987 A 5/1996 Tsuchiya
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A 4/1997 French
5,623,114 A 4/1997 Soper
5,625,971 A 5/1997 Tuma et al.
5,634,456 A 6/1997 Perrone
5,635,664 A 6/1997 Pons et al.
5,640,794 A 6/1997 Gardner et al.
5,655,326 A 8/1997 Levavi et al.
5,666,754 A * 9/1997 de Oliveira Masina ..... 42/70.08
5,669,169 A 9/1997 Schmitter et al.
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,760,328 A 6/1998 Robbins
5,770,814 A 6/1998 Ealovega
5,778,585 A 7/1998 Sigg
5,778,587 A * 7/1998 Brandl et al. ..... 42/70.08
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,134,852 A 10/2000 Shipman et al.
6,164,001 A 12/2000 Lee
6,205,694 B1 3/2001 Davis, Sr.
6,240,669 B1 6/2001 Spaniel et al.
6,253,479 B1 7/2001 Fuchs et al.
6,256,918 B1 * 7/2001 Szabo ..... 42/70.08
6,256,920 B1 7/2001 Olson
6,263,607 B1 7/2001 Fuchs et al.
6,266,909 B1 7/2001 Fuchs et al.
6,272,683 B1 8/2001 Symms et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,374,526 B1 * 4/2002 Mochak ..... 42/70.08
6,381,892 B1 5/2002 Szabo et al.
6,382,200 B1 5/2002 Levkov
6,405,631 B1 6/2002 Milek
6,412,206 B1 7/2002 Strayer
6,415,702 B1 7/2002 Szabo et al.
6,425,199 B1 7/2002 Vaid et al.
6,448,939 B2 9/2002 Maruta
6,513,273 B2 2/2003 da Silveira
6,519,887 B1 2/2003 Allen et al.
6,526,684 B1 3/2003 Hickerson
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,824 B2 3/2004 Hruska
6,711,842 B1 3/2004 Chapman
6,718,680 B2 4/2004 Roca et al.
6,732,464 B2 5/2004 Kurvinen
6,735,897 B1 5/2004 Schmitter et al.
6,769,208 B2 * 8/2004 Beretta ..... 42/69.03
6,789,342 B2 9/2004 Wonisch et al.
7,213,359 B2 * 5/2007 Beretta ..... 42/70.08
2005/0011098 A1 * 1/2005 Fagundes de Campos .. 42/70.04
2005/0229462 A1 * 10/2005 McGarry ..... 42/70.08
2006/0048428 A1 * 3/2006 Thomele et al. ..... 42/70.08
2006/0265924 A1 * 11/2006 Bubits ..... 42/47
2008/0104874 A1 * 5/2008 Kiesel et al. ..... 42/70.08
2008/0148618 A1 * 6/2008 McGarry ..... 42/70.08

* cited by examiner

POSITIVE STRIKER LOCK SAFETY FOR USE WITH A FIREARM

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

FIELD OF THE INVENTION

This invention relates generally to firearms and, more particularly, to locking or safety devices for firearms that employ striker-type firing pin mechanisms.

BACKGROUND OF THE INVENTION

Fire control mechanisms used in semiautomatic handguns oftentimes utilize striker-type firing pins. In handguns that employ a striker-type firing pin, the trigger is connected to a trigger bar. Movement of the trigger causes movement of the trigger bar, which, in certain embodiments, causes a sear to rotate about a pivot point. The sear is typically an elongated element that is rotatable about a pivot point located substantially at one end thereof. Upon rotation of the sear, a spring is compressed and an upper portion of the sear is displaced relative to the firing pin. When the sear is displaced a sufficient distance to clear a depending leg of the firing pin, the firing pin is urged forward by a firing pin spring and strikes the rear of a ammunition cartridge, thereby discharging the firearm. In most handguns in which the firing pin is allowed to move forward upon clearing the sear, the sear retains the firing pin in a cocked position and prevents it from striking the rear of the cartridge.

SUMMARY OF THE INVENTION

A firearm includes a frame, a slide, a striker-type firing pin ("striker"), and a fire control mechanism, which includes a sear to controllably release the striker and a trigger bar for actuating the sear. According to an embodiment of the present invention, an automatic positive striker lock safety includes a pin-like safety element housed in a bore in the frame or slide, and biased in a downward direction to normally block the striker. The bottom end of the pin is rounded, and cooperates with a rearwards facing, sloped surface on the trigger bar. If the striker is freed for forward movement without a concomitant full rearwards movement of the trigger bar, the safety pin blocks the striker, preventing it from moving forward a sufficient distance for discharge of the firearm. However, as the trigger bar and its sloped surface move rearwards upon a user pulling the trigger, the rounded bottom of the pin tracks along the sloped surface of the trigger bar. This forces the pin in an upward direction. Just before the trigger bar reaches its fully rearward position, the pin disengages from the striker (and/or moves to a position no longer blocking the striker). Incremental movement of the trigger bar to its fully rearward position actuates the sear for releasing the striker, which, no longer blocked by the pin, is free to move forward.

One advantage of the striker lock safety of the present invention is that the operation of a firearm incorporating such a device is blocked when the sear is rotated out of engagement with the striker in a manner other than through rearwards movement of the trigger bar. In other words, the striker is maintained in a locked position unless and until the trigger is moved fully rearwards, even if the sear is pivoted or actuated before then. However, full rearwards movement of the trigger automatically causes the safety pin to unblock the striker, meaning that the user does not have to manually disengage the positive striker lock safety prior to discharging the firearm.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
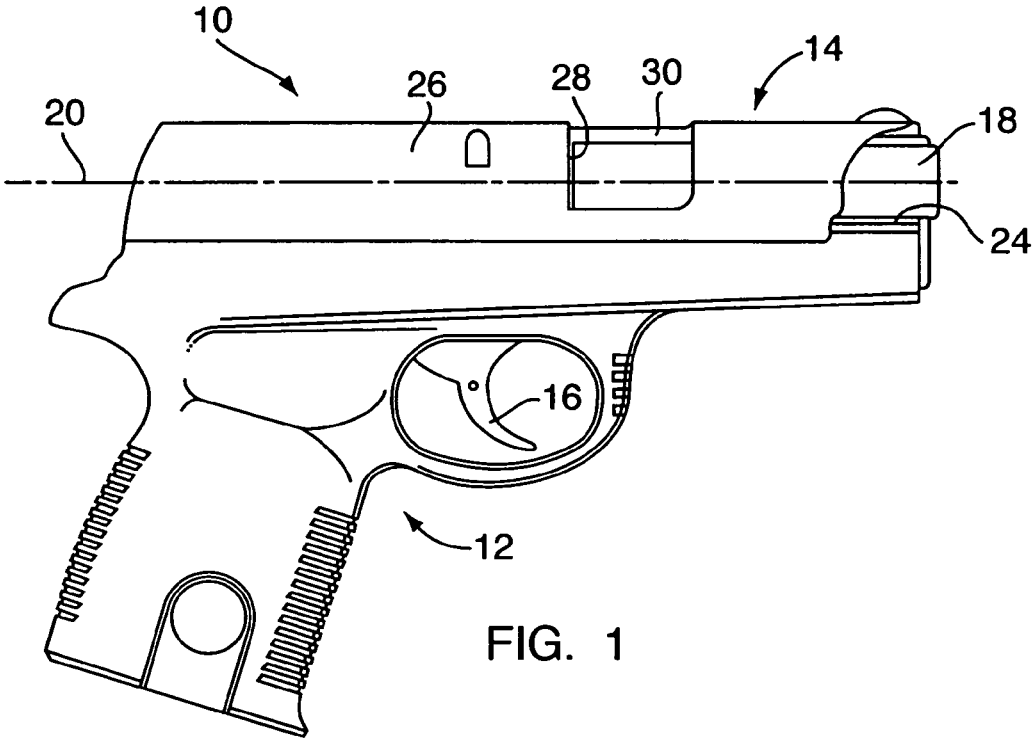
FIG. 1 is a simplified schematic side view of a semiautomatic pistol.
Figure 2:
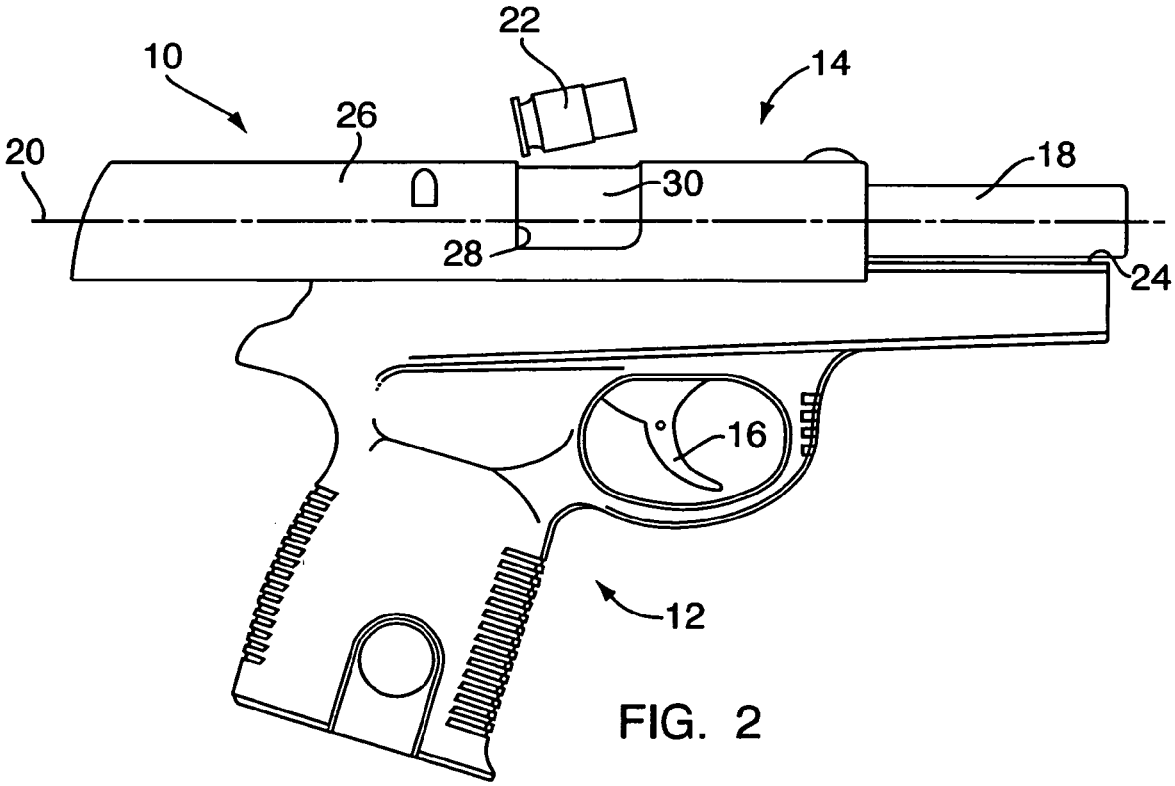
FIG. 2 is a simplified schematic side elevation view of the pistol of FIG. 1 shown with the slide moved to a rearward position on the pistol frame.

FIGS. 1 and 2 show one example of a semiautomatic pistol or handgun (hereinafter referred to as "firearm 10") that may incorporate a locking apparatus 70 according to an embodiment of the present invention. The firearm 10 comprises a frame 12, a slide 14, and a fire control mechanism that operates via actuation of a trigger 16. The frame 12 is fabricated of a high-impact polymer material, metal, a combination of polymer and metal, or other suitable material. The slide 14 houses a barrel 18 in the forward end thereof. The barrel 18 is cooperatively linked with the slide 14 and, together with the slide 14, defines a longitudinal firing axis 20. A rearward end of the barrel 18 is adapted for receiving an ammunition cartridge 22.

The slide 14 is fitted to oppositely positioned rails 24 on the frame 12 to effect the reciprocal movement of the slide 14 along the longitudinal firing axis 20. The rails 24 extend along the underside of the slide 14 in the longitudinal direction and are cooperative with the frame 12 to allow the cycling of the slide 14 between forward (battery) and rearward (retired) positions. The slide 14, which is defined by a slide frame 26, further includes a breech face 28 and an extractor port 30. The breech face 28 is engagable with the rearward end of the barrel 18 to form a firing chamber when the slide 14 is disposed forwardly on the frame 12 (FIG. 1). An ejection mechanism provides for the ejection of a cartridge casing 22 upon firing the firearm 10 or manually cycling the slide 14.

Figure 3:
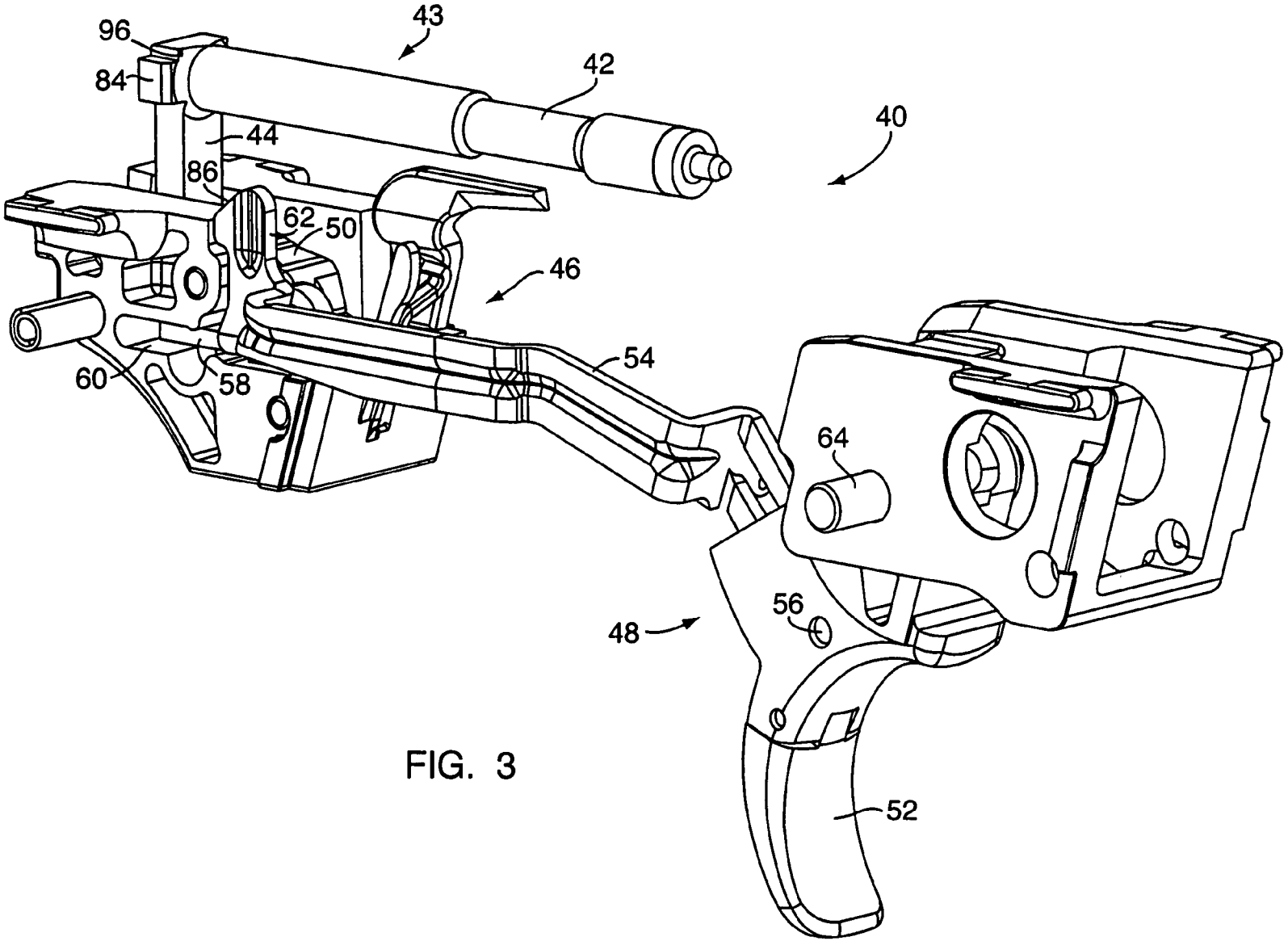
FIG. 3 is a simplified schematic perspective view of a trigger assembly and a sear assembly portion of a semiautomatic pistol according to an embodiment of the present invention.

Referring now to FIG. 3, the fire control mechanism is shown at 40. The fire control mechanism 40 is of a striker-type firing pin configuration and comprises a striker-type firing pin 43 ("striker") having a firing pin portion 42 and a depending leg 44. The fire control mechanism further comprises a sear assembly 46 and a trigger assembly 48. The sear assembly 46 includes a pivotally mounted sear 50 that engages the striker 43. The trigger assembly 48, which functions to actuate the sear 50, includes a trigger 52 and a trigger bar 54 pivotally connected to the trigger 52 via a pin 56. The trigger bar 54 functionally connects the trigger 52 and the sear assembly 46.

A trigger bar extension 58 extends from the trigger bar 54 into a channel 60 of the sear assembly 46, and an arm-like trigger bar safety deactivation member 62 extends substantially vertically from the trigger bar 54. The trigger 52 may be of unitary construction, as shown, or of a multiple-piece articulated construction.

When the trigger 52 is actuated by being pressed in a rearward direction, the trigger 52 pivots about a pin 64 and transmits movement to the trigger bar 54 via the pin 56. The trigger bar 54 is thereby moved in a rearward direction substantially parallel to the longitudinal firing axis 20 such that the trigger bar extension 58 correspondingly translates in the channel 60. A portion of the trigger bar operationally abuts the sear 50 for actuating the sear when the trigger bar is moved rearwards. However, the connection of the trigger assembly 48 and the sear assembly 46 is such that the trigger bar 54 is laterally displaced out of abutment/engagement with the sear 50 when sufficient force is exerted on the trigger bar extension 58 in a direction that is perpendicular to the direction in which the longitudinal firing axis extends.

Referring now to FIGS. 4, 5, and 6A-6C, a striker lock safety assembly 70 is shown in relation to the fire control mechanism 40 and the sear assembly 46 and is hereinafter referred to as the "safety assembly 70." The safety assembly 70 comprises a pin-like member 72 having a first lobe or upper portion 74 and a second lobe or bottom portion 76 positioned at respective ends of a narrower, cylindrical center or intermediate portion 78. (The second lobe 76 may also have a diameter equal to or smaller than the center portion 78.) The pin 72 may be cylindrical in overall shape, although other geometries may be utilized. When the pin 72 is mounted in the firearm 10, the first lobe 74 is positioned at the top of the pin 72 and the second lobe 76 is positioned at the bottom of the pin 72. The pin 72 is free to move in a longitudinal direction perpendicular to the striker 43 and firing axis 20, but is otherwise restricted in motion. For this, the pin 72 may be positioned in a correspondingly dimensioned bore or aperture (not shown) provided in the slide 14 or otherwise.

Figure 4:
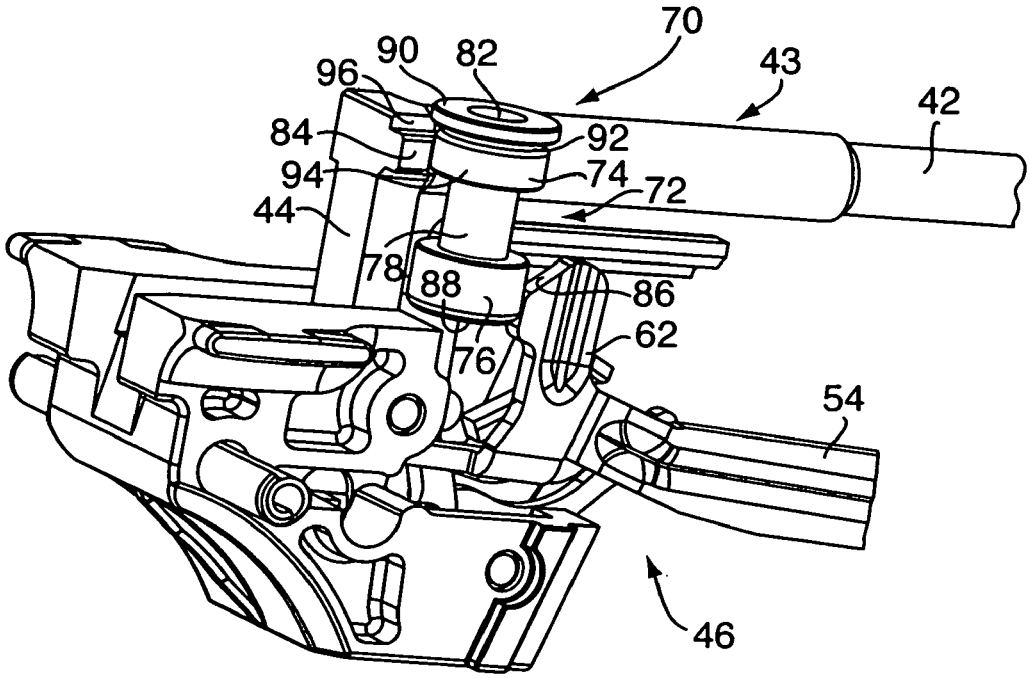
FIG. 4 is a simplified schematic perspective view of a positive striker lock safety according to an embodiment of the present invention, in relation to the sear assembly.
Figure 5:
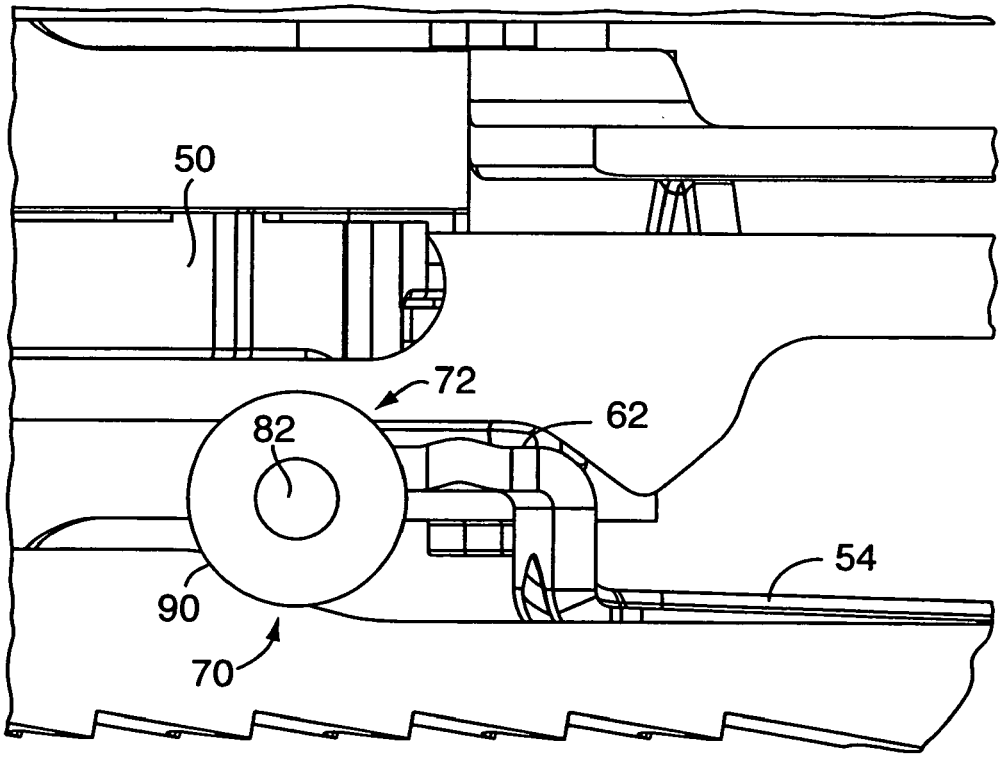
FIG. 5 is a simplified schematic top plan view of the positive striker lock safety.
Figure 6A:
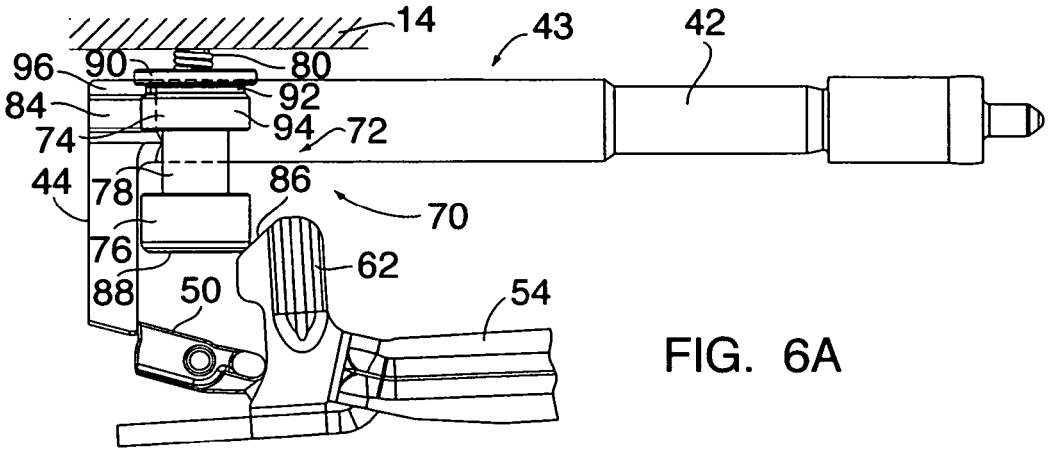
FIGS. 6A-6C are simplified schematic side elevation views showing the positive striker lock safety in operation.
Figure 6B:
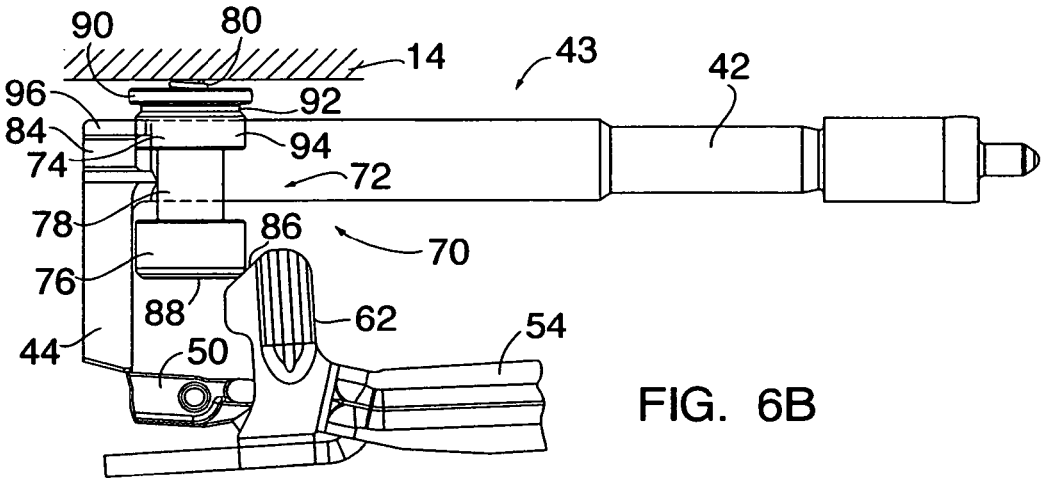
Figure 6C:
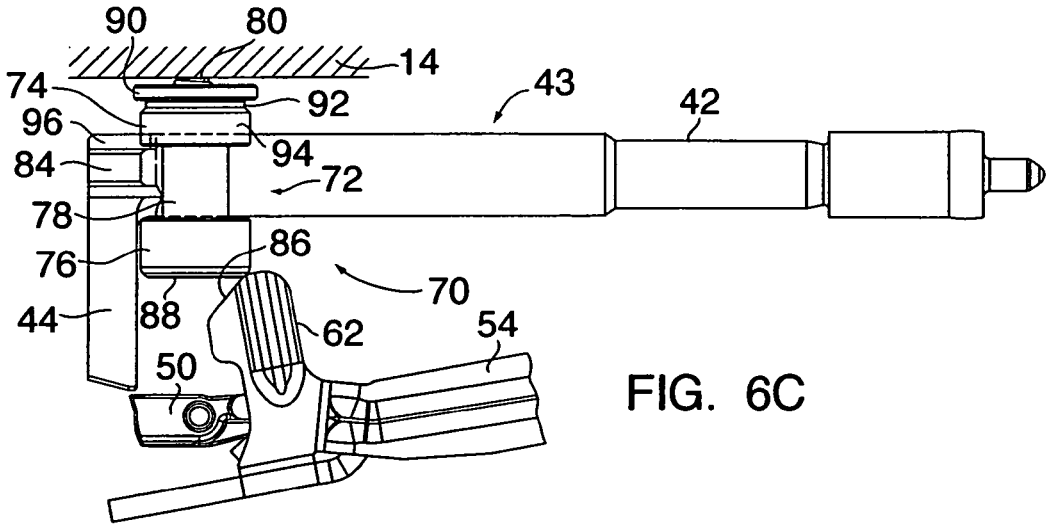

The safety assembly 70 further comprises a compression spring or other biasing member 80 (see FIGS. 6A-6C). One end of the compression spring 80 engages the first lobe 74 by way of, e.g., a bore 82 or other concavity in the top surface of the first lobe 74. The other end of the spring 80 is held in place against the underside or interior of the slide 14 and/or some other portion of the frame 12. The spring 80 biases the pin 72 in a downward direction and into a safety position, as shown in FIGS. 4 and 6A.

In its safety position, the first lobe 74 of the pin 72 engages and/or abuts a protrusion 84 extending out from the side of the firing pin 42 and perpendicular to both the firing pin 42 and extension 44. In this position, the pin 72 prevents the striker 43 from moving in a forward direction, because the first lobe 74 blocks the protrusion 84. The pin 72 is prevented from further downwards movement by virtue of the firing pin protrusion 84 blocking its downward path, and/or because the second lobe 76 abuts the trigger bar deactivation member 62.

As noted, the lower, second lobe 76 abuts the trigger bar deactivation member 62. The member 62 has a rearward-facing, inclined surface 86 (see especially FIG. 2), which cooperates with a bottom, rounded or dome-shaped surface 88 of the second lobe 76. As should be appreciated, when the trigger bar 54 and deactivation member 62 are moved rearwards, the second lobe 76 tracks along the inclined surface 86. This forces the pin 72 to move in an upward direction against the biasing action of the spring 80 and towards a "retracted," non-safety position as shown in FIG. 6C.

Typically, with the trigger 16 and trigger bar 54 in their forward, un-actuated positions, the sear 50 blocks the striker extension 44. This prevents the striker 43 from moving forwards, as would cause a round of ammunition to discharge. Then, when a user desires to fire the firearm 10, the trigger 16 is actuated, causing the trigger bar 54 to move rearwards and the sear 50 to pivot downwards, unblocking the striker extension 44. However, even if the trigger bar 54 is not moved fully rearwards, it may be possible (albeit unlikely) for the sear 50 to disengage from the striker extension 44, e.g., if the trigger is "staged" (pulled rearwards just short of the expected firing position) or if the firearm 10 is sharply jolted.

Accordingly, in operation, the safety pin 72 normally lies in its safety position, as shown in FIGS. 6A and 6B. Here, the first lobe 74 blocks the striker protrusion 84, preventing the striker 43 from moving forwards. This is true even if the sear 50 is somehow disengaged from the striker extension 44 without full rearwards movement of the trigger bar 54, as shown in FIG. 6B. Thus, the safety assembly 70 works to positively prevent the striker from moving forward or backward unless the trigger is fully actuated.

Disengagement of the safety assembly 70 occurs automatically upon rearwards movement of the trigger 16 and trigger bar 54, and without the user having to separately manually disengage the safety assembly 70. Specifically, as the trigger bar 54 is urged backwards, the inclined surface 86 of the deactivation member 62 engages the second lobe 76 along its rounded bottom surface 88. This forces the pin 72 to move upwards. Once the pin 72 is moved fully upwards to its retracted position, the first lobe 74 no longer lies in blocking engagement or abutment with the protrusion 84. Additionally, the cylindrical center portion 78 of the safety is relieved or recessed enough to allow the striker 43 to clear the pin 72, and the firearm is operable, the striker being allowed to reciprocate forward and backwards along the path of movement.

As should be appreciated, the safety assembly 70 is configured, in relation to the sear assembly and trigger assembly, so that the following occurs in succession as the trigger 16 is pulled rearwards: (i) pin 72 is urged upwards towards its retracted position; (ii) the pin 72 reaches its retracted, non-safety position; and (iii) the sear 50 is pivoted downwards out of engagement with the striker extension 44. The latter action will typically occur either simultaneously with, or just slightly after, the pin 72 reaching its retracted position out of blocking engagement with the striker 43.

As best seen in FIG. 4, the first lobe 74 of the pin 72 may be further delineated into an upper annular portion 90 having a first diameter, an intermediate annular portion 92 having a second diameter less than the first diameter, and a lower annular portion 94 having a third diameter between the first and second diameters. Here, the upper annular portion 90 blocks a top shoulder portion 96 of the striker 42, while the lower annular portion 94 blocks the protrusion 84, which forms a bottom shoulder portion. In the retracted position of the pin 72, the upper annular portion 90 lies above the shoulder 96, while the lower portion 94 lies in a clearance notch between the shoulder 96 and protrusion 84.

An embodiment of the present invention may be characterized as including: a frame; a slide cooperative with the frame; a firing pin assembly operatively attached to the frame and/or slide and comprising a striker, an extension attached to the striker, and a protrusion attached to the striker; a sear attached to the frame and normally blocking the extension, the sear being moveable to a non-blocking position of the extension; a trigger assembly including a trigger pivotally attached to the frame and a trigger bar pivotally attached to the trigger bar, the trigger bar being cooperative with the sear for moving the sear to the non-blocking position, and the trigger bar including a safety arm; and a safety assembly including a spring-biased pin having a first end and a second end. Additionally, the pin normally lies in a safety position where the first end of the pin blocks the protrusion and prevents the striker from moving in a forwards direction and the second end of the pin lies proximate to the safety arm, and upon movement of the trigger bar to move the sear towards the non-blocking position the safety arm tracks along the second end of the pin forcing the pin to move to a retracted position wherein the first end of the pin no longer blocks the protrusion, at the same time as, or proximate to, the sear reaching the non-blocking position.

As should be appreciated, although the pin 72 has been illustrated as having a first or top lobe 74 cooperative with a protrusion 84 on the striker 43 for blocking the striker and firing pin, the pin could instead be provided with a tab-like protrusion or the like for engaging a slot provided in the side and/or top of the firing pin. When in the safety position, the tab would lie in the slot, preventing forward movement of the firing pin. When in the retracted position, the tab would like out of the slot and retracted in a clearance in the frame/slide provided as part of the bore for housing the pin 72.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A firearm comprising:

a frame;

a slide operably connected to the frame;

a striker operably connected to at least one of the frame and slide;

a fire control mechanism operably connected to the frame for selective actuation of the striker, said fire control mechanism having a trigger bar having a forward end and an aft end; and a striker safety pin connected to at least one of the frame and slide, said pin having a longitudinal axis and being biased at a first position to block forward movement of the striker; and wherein the trigger bar has a safety deactivation member located on the aft end thereof for slidably engaging the striker safety pin for moving the pin to a second position to unblock the striker, without rotation of the safety deactivation member relative to the trigger bar, when the trigger bar and safety deactivation member are moved to a rearwards position, the safety deactivation member extending substantially vertically and having a rearwards sloping surface;

wherein the trigger bar has a trigger bar extension located at the aft end thereof which translates into a corresponding channel when the trigger bar is moved to a rearwards position to prevent movement of the trigger bar in a direction substantially parallel to the longitudinal axis of the striker safety pin; and wherein a bottom of the striker safety pin has a rounded surface for tracking along the rearwards sloping surface of the safety deactivation member when the trigger bar is moved to a rearwards position, for moving the pin in the second direction to unblock the striker.

2. The firearm of claim 1 wherein:

the fire control mechanism further comprises a pivoting sear for selectively releasably engaging the striker, said trigger bar operably engaging the sear for actuation of the sear to release the striker; and the sear, trigger bar, striker safety pin, and safety deactivation member are cooperatively configured for the safety deactivation member to automatically move the pin to unblock the striker simultaneously with or just prior to the trigger bar actuating the sear to release the striker, upon movement of the trigger bar to the rearward position.

3. The firearm of claim 2 wherein:

the striker safety pin comprises a first portion, a center portion connected to the first portion, and a second portion connected to the center portion, said first portion being wider than the center portion;

the striker comprises a firing pin portion and a protrusion connected to the firing pin portion and perpendicular thereto; and in the first position the first portion of the striker safety pin lies forward of and coplanar with the striker protrusion to block forward movement of the striker, and in the second position the first portion of the striker safety pin lies above the striker protrusion and unblocking the striker, said protrusion being aligned with a clearance formed between the striker safety pin first portion and center portion for accommodating forward movement of the striker.

4. The firearm of claim 3 wherein:

the striker protrusion has an upper shoulder and a lower shoulder; and the first portion of the striker safety pin has upper and lower portions separated by an intermediate portion having a narrower width than either of the upper and lower portions, said upper and lower portions being respectively cooperative with the upper and lower shoulders of the striker protrusion for blocking the striker when the striker safety pin is in the first position.

5. The firearm of claim 3 wherein the longitudinal axis is perpendicular to the firing pin portion and protrusion of the striker.

6. The firearm of claim 1 wherein:

the striker safety pin comprises a first portion, a center portion connected to the first portion, and a second portion connected to the center portion, said first portion being wider than the center portion;

the striker comprises a firing pin portion and a protrusion connected to the firing pin portion; and in the first position the first portion of the striker safety pin lies forward of and coplanar with the striker protrusion to block forward movement of the striker, and in the second position the first portion of the striker safety pin lies above the striker protrusion and unblocking the striker, said protrusion being aligned with a clearance formed between the striker safety pin first portion and center portion for accommodating forward movement of the striker.

7. The firearm of claim 6 wherein:

the striker protrusion has an upper shoulder and a lower shoulder; and the first portion of the striker safety pin has upper and lower portions separated by an intermediate portion having a narrower width than either of the upper and lower portions, said upper and lower portions being respectively cooperative with the upper and lower shoulders of the striker protrusion for blocking the striker when the striker safety pin is in the first position.

8. The firearm of claim 6 wherein the longitudinal axis is perpendicular to the firing pin portion and protrusion of the striker.

9. The firearm of claim 1 wherein:

the fire control mechanism further comprises a pivoting sear for selectively releasably engaging the striker, said trigger bar operably engaging the sear for actuation of the sear to release the striker; and the sear, trigger bar, striker safety pin, and safety deactivation member are cooperatively configured for the safety deactivation member to move the pin to unblock the striker simultaneously with or just prior to the trigger bar actuating the sear to release the striker, upon movement of the trigger bar to the rearwards position.

10. The firearm of claim 9 wherein:

the striker safety pin comprises a first portion, a center portion connected to the first portion, and a second portion connected to the center portion, said first portion being wider than the center portion;

the striker comprises a firing pin portion and a protrusion connected to the firing pin portion; and in the first position the first portion of the striker safety pin lies forward of and coplanar with the striker protrusion to block forward movement of the striker, and in the second position the first portion of the striker safety pin lies above the striker protrusion and unblocking the striker, said protrusion being aligned with a clearance formed between the striker safety pin first portion and center portion for accommodating forward movement of the striker.

11. The firearm of claim 10 wherein:

the striker protrusion has an upper shoulder and a lower shoulder; and the first portion of the striker safety pin has upper and lower portions separated by an intermediate portion having a narrower width than either of the upper and lower portions, said upper and lower portions being respectively cooperative with the upper and lower shoulders of the striker protrusion for blocking the striker when the striker safety pin is in the first position.

12. A fire control mechanism for a firearm comprising:

a striker;

a sear assembly cooperative with the striker for controlled release of the striker;

a striker lock pin having a longitudinal axis and biased in a first direction to block forward movement of the striker; and a trigger bar having a forward end and an aft end, the trigger bar being cooperative with the sear assembly for selective actuation of the sear assembly to release the striker, wherein the trigger bar comprises a safety deactivation member located on the aft end thereof for slidably engaging the striker lock pin for moving the pin in a second direction to unblock the striker, without rotation of the safety deactivation member relative to the trigger bar, when the trigger bar and safety deactivation member are moved to a rearwards position actuating the sear assembly, said safety deactivation member extending substantially vertically and having a rearwards sloping surface; and wherein the trigger bar has a trigger bar extension located at the aft end thereof which translates into a corresponding channel when the trigger bar is moved to a rearwards position to prevent movement of the trigger bar in a direction substantially parallel to the longitudinal axis of the striker lock pin; and wherein a bottom of the striker lock pin is rounded to track along the sloped surface of the safety deactivation member for moving the striker lock pin in the second direction when the trigger bar is moved rearwards.

13. The fire control mechanism of claim 12 wherein:

the striker lock pin comprises an upper portion, a center portion connected to the upper portion, and a lower portion connected to the center portion, said upper portion being wider than the center portion;

the striker comprises a firing pin portion and a protrusion connected to the firing pin portion; and in a first position of the striker lock pin the upper portion lies forward of and coplanar with the striker protrusion to block forward movement of the striker, and in a second position of the striker lock pin the upper portion lies above the striker protrusion and unblocking the striker, said protrusion being aligned with a clearance formed between the striker lock pin upper portion and center portion for accommodating forward movement of the striker.

14. The fire control mechanism of claim 13 wherein:

the safety deactivation member comprises a rearwards facing sloped surface; and a bottom of the striker lock pin is rounded to track along the sloped surface of the safety deactivation member for moving the striker lock pin in the second direction when the trigger bar is moved rearwards.

15. The fire control mechanism of claim 12 wherein:

the striker lock pin comprises a center portion and an upper portion connected thereto and having a greater width than the center portion; and the striker comprises a firing pin portion and a protrusion connected thereto, said striker lock pin being biased in the first direction for the upper portion to cooperate with the protrusion to block forward movement of the striker.

16. The fire control mechanism of claim 15 wherein:

the safety deactivation member comprises a rearwards facing sloped surface; and a bottom of the striker lock pin is rounded to track along the sloped surface of the safety deactivation member for moving the striker lock pin in the second direction when the trigger bar is moved rearwards.

17. The fire control mechanism of claim 16 wherein:

the bottom of the striker lock pin comprises a domed surface in contact with the sloped surface of the safety deactivation member.

18. A firearm comprising:

a striker having a firing pin portion defining a firing pin longitudinal axis and a protrusion connected to the firing pin portion and extending perpendicularly therefrom for selectively actuating ammunition cartridges;

a fire control mechanism for selective actuation of the striker, said fire control mechanism having a trigger bar having a forward end and an aft end;

striker safety means for blocking forward movement of the striker; and safety deactivation means connected to the aft end of the trigger bar for slidably engaging said striker safety means when the trigger bar and the safety deactivation means are moved to a rearwards position;

wherein said safety deactivation means extends substantially vertically and includes a rearwards sloping surface for automatically causing the striker safety means to unblock the striker when the trigger bar is moved rearwards; and wherein the trigger bar includes a means for preventing movement of the trigger bar in a direction perpendicular to the firing pin longitudinal axis and perpendicular to the direction of extension of the protrusion.

* * * * *